US008113883B2

(12) United States Patent
Chen et al.

(10) Patent No.: US 8,113,883 B2
(45) Date of Patent: Feb. 14, 2012

(54) CARD CONNECTOR WITH DOUBLE LOCKING PORTIONS BETWEEN METAL SHIELD AND INSULATIVE HOUSING THEREOF

(75) Inventors: Zhi-Jian Chen, Kunshan (CN); Zhi-Feng Wang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/713,182

(22) Filed: Feb. 26, 2010

(65) Prior Publication Data

US 2010/0221942 A1 Sep. 2, 2010

(30) Foreign Application Priority Data

Feb. 27, 2009 (CN) ..... 200920300934.1

(51) Int. Cl.
*H01R 13/648* (2006.01)

(52) U.S. Cl. ..... 439/607.33

(58) Field of Classification Search ..... 439/607.33, 439/607.31, 607.32, 607.35–607.4, 607.23–607.26, 439/633, 630, 326, 325
See application file for complete search history.

(56) References Cited

U.S. PATENT DOCUMENTS 6,290,136 B1 * 9/2001 Koseki et al. ..... 235/475
6,655,973 B2 * 12/2003 Ji et al. ..... 439/159
7,014,481 B2 * 3/2006 Miyamoto ..... 439/95
7,214,098 B2 * 5/2007 Matsumoto et al. ..... 439/630
7,331,822 B2 * 2/2008 Chen n ..... 439/607.01
7,445,503 B1 * 11/2008 Zhang ..... 439/607.01
7,510,415 B2 * 3/2009 Wang ..... 439/159
7,563,138 B2 * 7/2009 Zhang et al. ..... 439/630
7,727,023 B2 * 6/2010 Ting ..... 439/630
2003/0064627 A1 * 4/2003 Ooya et al. ..... 439/630
2005/0079766 A1 * 4/2005 Ho et al. ..... 439/630
2005/0095917 A1 * 5/2005 Miyamoto ..... 439/630
2005/0124222 A1 * 6/2005 Fan ..... 439/630
2007/0173118 A1 * 7/2007 Chen ..... 439/607
2008/0123320 A1 * 5/2008 Cheng ..... 361/823
2008/0207012 A1 * 8/2008 Cheng et al. ..... 439/64

FOREIGN PATENT DOCUMENTS

CN 2831501 10/2006

* cited by examiner

*Primary Examiner* — Tulsidas C Patel
*Assistant Examiner* — Harshad Patel
(74) *Attorney, Agent, or Firm* — Ming Chieh Chang; Wei Te Chung; Andrew C. Cheng

(57) ABSTRACT

An electrical card connector (100) includes an insulative housing (2, 4, 6) defining a number of passageways, a number of contacts (12) retained in the passageways and the insulative housing and a metal shield (3, 5, 7) covering the insulative housing. The insulative housing has a base portion (20, 40) and a pair of retaining portions (22, 42, 62) extending forwardly from the base portion. Each retaining portion defines a cavity (24, 44, 45, 63). The metal shield includes a main portion (30) and a number of lateral walls (31) for defining a card receiving room. The metal shield integrally forms a locking portion (34, 54, 55, 75) having a stamped portion (341, 543, 553, 751) therefrom. The stamped portion is received in the cavity to pre-loadingly engage with the retaining portion.

3 Claims, 12 Drawing Sheets

CARD CONNECTOR WITH DOUBLE LOCKING PORTIONS BETWEEN METAL SHIELD AND INSULATIVE HOUSING THEREOF

BACKGROUND OF THE INVENTION

1. Field of the Invention

The present invention relates generally to an electrical card connector, and more particularly to an express card connector having double locking portions for providing reliable attachment between a metal shield and an insulative housing thereof.

2. Description of Related Arts

An express card connector usually includes an insulative housing, a plurality of contacts retained in the insulative housing, a metal shield covering the insulative housing for defining a card receiving room therebetween, a guiding member for guiding an inserted card into the card receiving room and an ejector assembled at a side of the insulative housing for ejecting the card from the card receiving room. The contacts are soldered on a printed circuit board (PCB) and the insulative housing is assembled on the PCB thereby. The metal shield usually defines a plurality of cutouts and the insulative housing correspondingly forms a plurality of blocks interferencely protruding into the cutouts. Therefore, the metal shield and the insulative housing are secured with each other thereby. However, the express card connector needs to be repaired because something thereof may be damaged in the assembling process or may be in fault in the following, daily use. Under such a condition, the metal shield is required to be removed from the insulative housing. A repairer needs rather large strength to separate the blocks from the cutouts, which may cause damage to the express card connector, or even damage to the PCB.

Hence, an electrical card connector having a metal shield and an insulative housing easily separated from each other is desired.

SUMMARY OF THE INVENTION

Accordingly, an object of the present invention is to provide an electrical card connector having a metal shield and an insulative housing easily separated from each other, facilitating a repairer to repair the electrical card connector when it doesn't work.

To achieve the above object, an electrical card connector includes an insulative housing defining a plurality of passageways, a plurality of contacts retained in the passageways and the insulative housing and a metal shield covering the insulative housing. The insulative housing has a base portion and a pair of retaining portions extending forwardly from the base portion. Each retaining portion defines a cavity. The metal shield includes a main portion and a plurality of lateral walls for defining a card receiving room. The metal shield integrally forms a locking portion having a stamped portion therefrom. The stamped portion is received in the cavity to pre-loadingly engage with the retaining portion.

Other objects, advantages and novel features of the invention will become more apparent from the following detailed description when taken in conjunction with the accompanying drawings.

DETAILED DESCRIPTION OF THE PREFERRED EMBODIMENT

Figure 1:
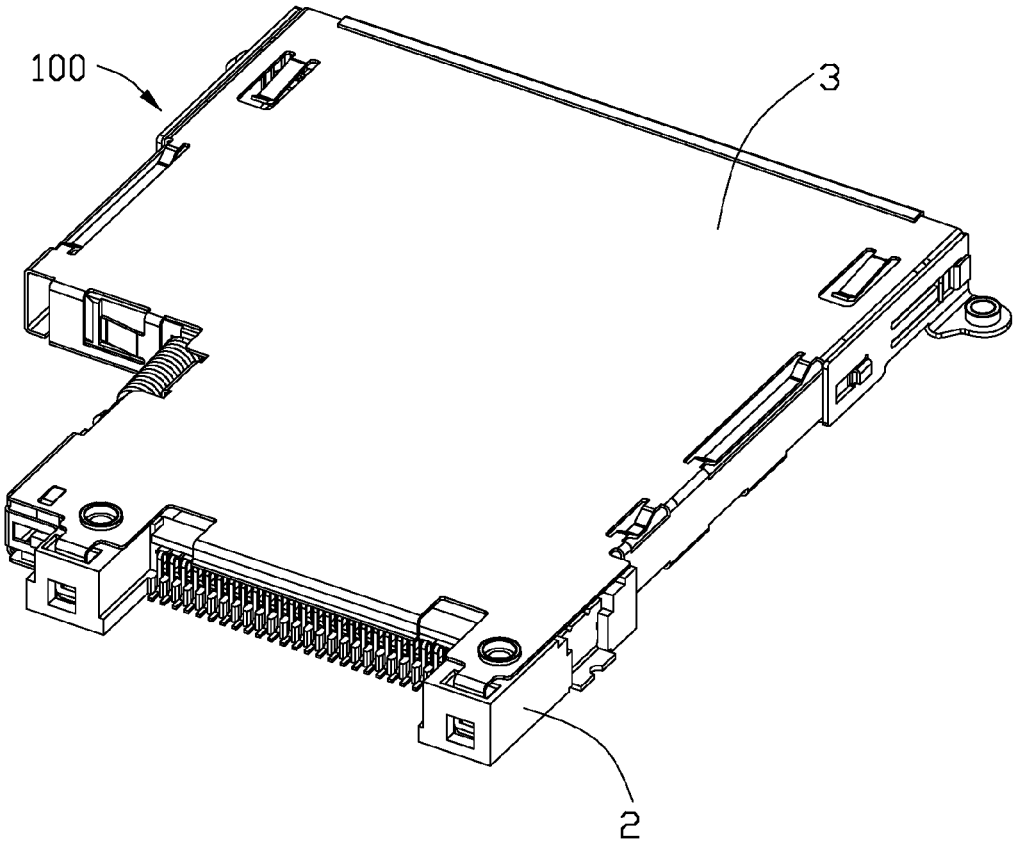
FIG. 1 is a perspective, assembled view of a first embodiment of an electrical card connector constructed in accordance with the present invention.
Figure 2:
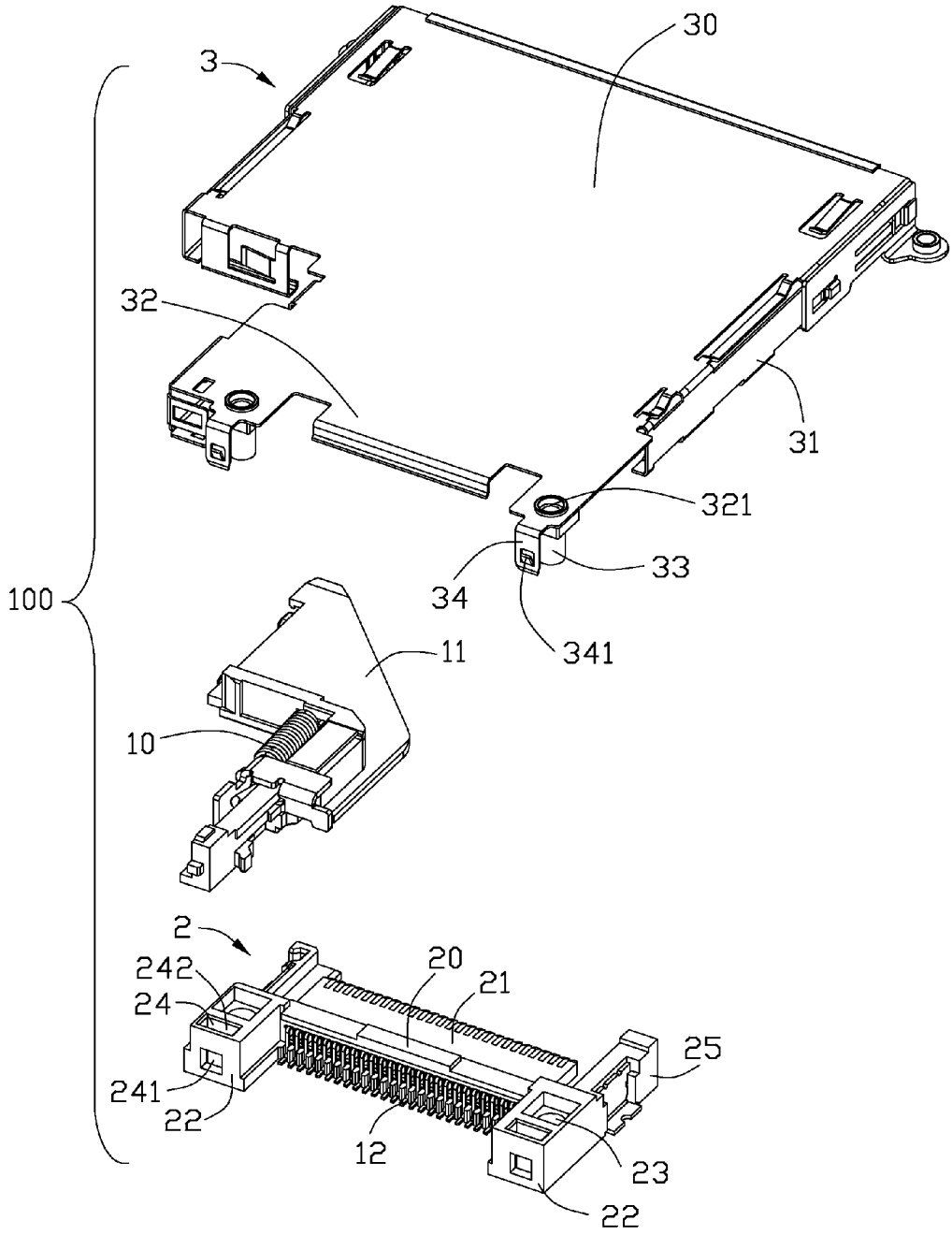
FIG. 2 is a perspective, exploded view of the electrical card connector of FIG. 1.
Figure 3:
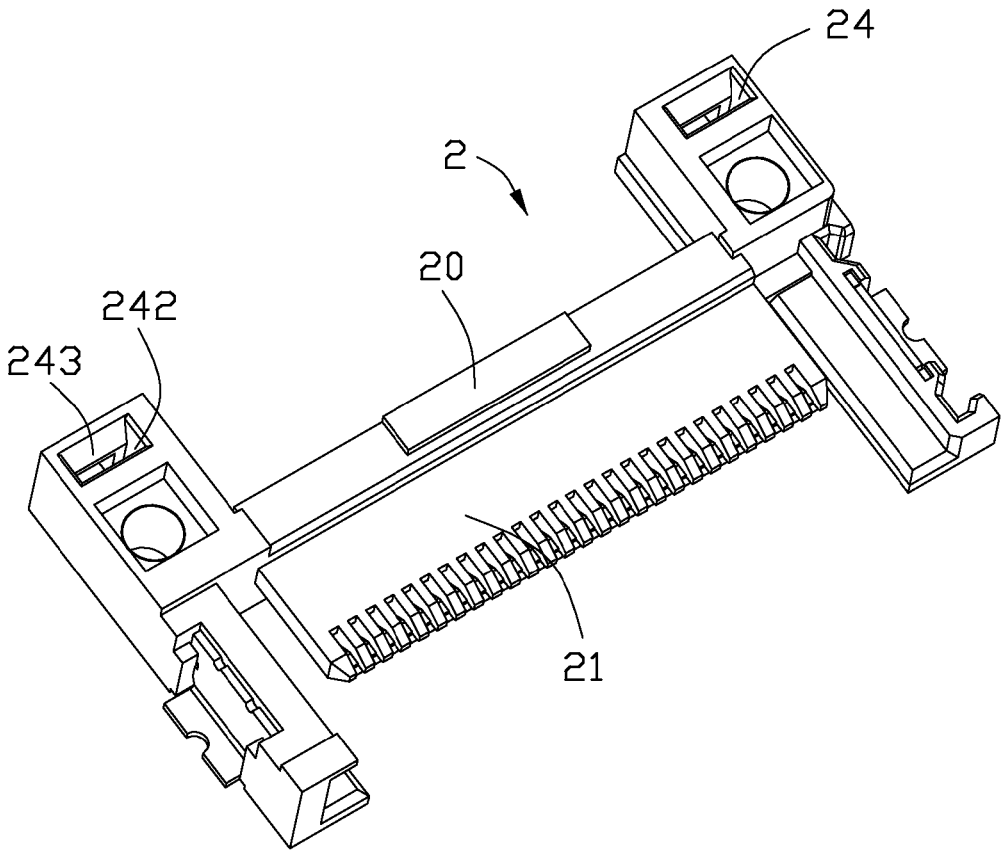
FIG. 3 is a perspective view of an insulative housing of the electrical card connector of FIG. 1.

Referring to FIGS. 1-3, a first embodiment of an electrical card connector 100 of the present invention includes an insulative housing 2, a plurality of contacts 12 retained in the insulative housing 2, a metal shield 3 covering the insulative housing 2 for defining a card receiving room therebetween, a guiding member 11 assembled at a side of the insulative housing 2, and an ejector 10 assembled on the guiding member 11 for ejecting an inserted card from the card receiving room. The electrical card connector 100 essentially receives two kinds of express cards standardized by PCMCIA (Personal Computer Memory Card International Association), which is widely known by persons in the skilled art, and it is not described in detail herein.

Referring to FIGS. 2-3, the insulative housing 2 is rectangular and comprises an elongate base portion 20, a pair of lateral walls 25 extending backwardly from two ends of the base portion 20, and a tongue portion 21 extending backwardly from the base portion 20 to be located between the lateral walls 25. The insulative housing 2 defines a plurality of passageways (not labeled) in the base portion 20 and the tongue portion 21, and the contacts 12 are received in the passageways, with a plurality of first ends extending out of the base portion 20 for soldering on a printed circuit board (PCB, not shown) while a plurality of second ends extending beyond the tongue portion 21 for mating with the inserted card. The insulative housing 2 further includes a pair of retaining portions 22 extending forwardly from the lateral walls 25 along a card insertion direction. The retaining portions 22 and the lateral walls 25 are respectively located at two opposite sides of the base portion 20 along an elongated direction of the base portion 20 which is transverse to the card insertion direction. Each retaining portion 22 defines a slot 23 extending from an upper surface thereof to a lower surface thereof. The retaining portion 22 further defines an L-shaped cavity 24 having a first opening 242 on the upper surface thereof and a second opening 241 on a front surface thereof. The L-shaped cavity 24 defines a slope portion 243 in a vertical direction adjacent to the first opening 242.

Referring to FIGS. 1-3, the metal shield 3 has an L-shaped main portion 30 and a plurality of lateral walls 31 extending vertically from the main portion 30. The main portion 30 has a head portion 32 with a narrower width at the front thereof. The head portion 32 covers the insulative housing 2 and is secured to the insulative housing 2. The head portion 32 forms a locking portion 34 bending vertically from a front edge thereof. The locking portion 34 forms a stamped portion 341 with a free end upwardly and outwardly away from the locking portion 34. The locking portion 34 is guided by the slope portion 241 through the first opening 242. The locking portion 34 protrudes into the L-shaped cavity 24, during which the stamped portion 341 is compressed to have elasticity. The elasticity of the stamped portion 341 doesn't release until the stamped portion 341 meets the second opening 241. At last, the stamped portion 341 protrudes into the second opening 241 and engages with the retaining portion 22. The locking portion 34 is concaved in the L-shaped cavity 24, just providing a pre-loading engagement between the metal shield 3 and the insulative housing 2. In a repairing process, because the stamped portion 341 is concaved in the second opening 241, the repairer uses an instrument to push the stamped portion 341 inwardly to disengage the locking portion 34 with the retaining portion 22. Thereafter, the repairer easily separates the metal shield 3 away from the insulative housing 2 without damage and checks what is wrong with the electrical card connector 100. The head portion 32 defines a pair of hollow elements 33 each with an aperture 321. The hollow element 33 is orientated in the slot 23. A screwing bolt (not shown) goes through the aperture 321, the slot 23 in turn and at last, achieves the PCB. The screwing bolt provides a main screwing force between the electrical card connector 100 and the PCB, during which the metal shield 3 is fixedly assembled to the insulative housing 2. The screwing bolt is alternatively, integrally formed on the metal shield 3. Though the screwing manner is necessary in other embodiments, which will be shown following, but also the same as described in the first embodiment, therefore, it is not described in detail later.

Figure 4:
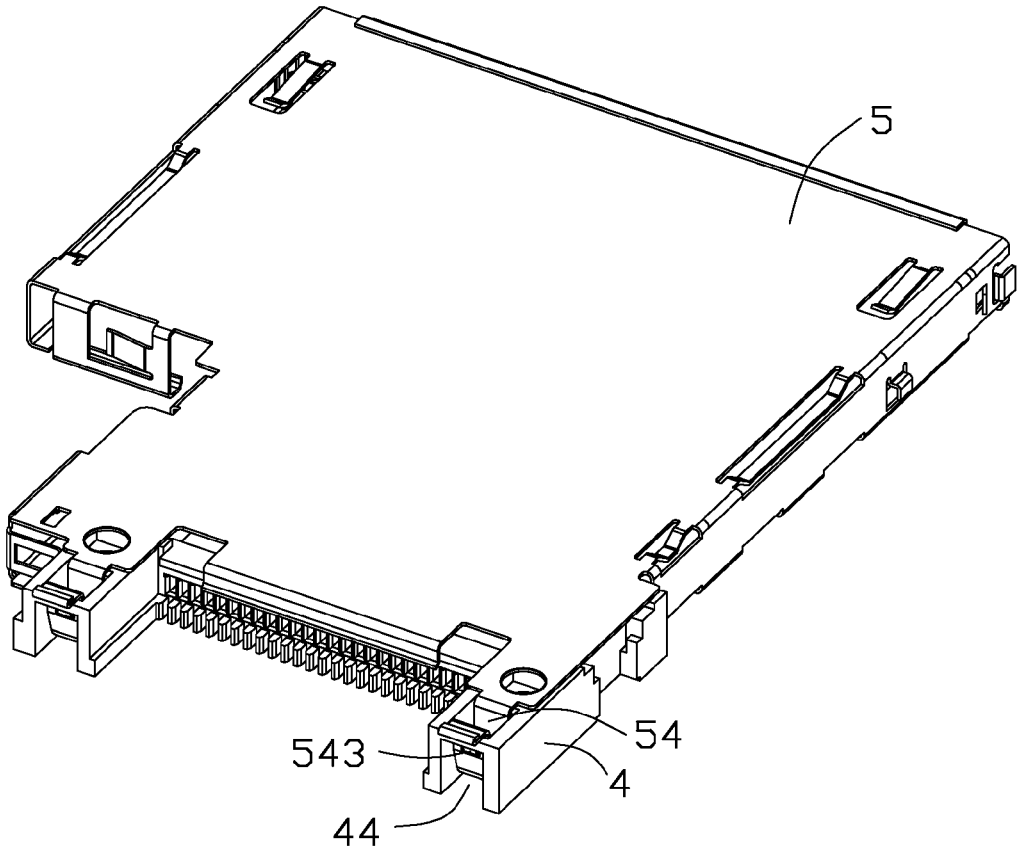
FIG. 4 is a perspective, assembled view of a second embodiment of the electrical card connector.
Figure 5:
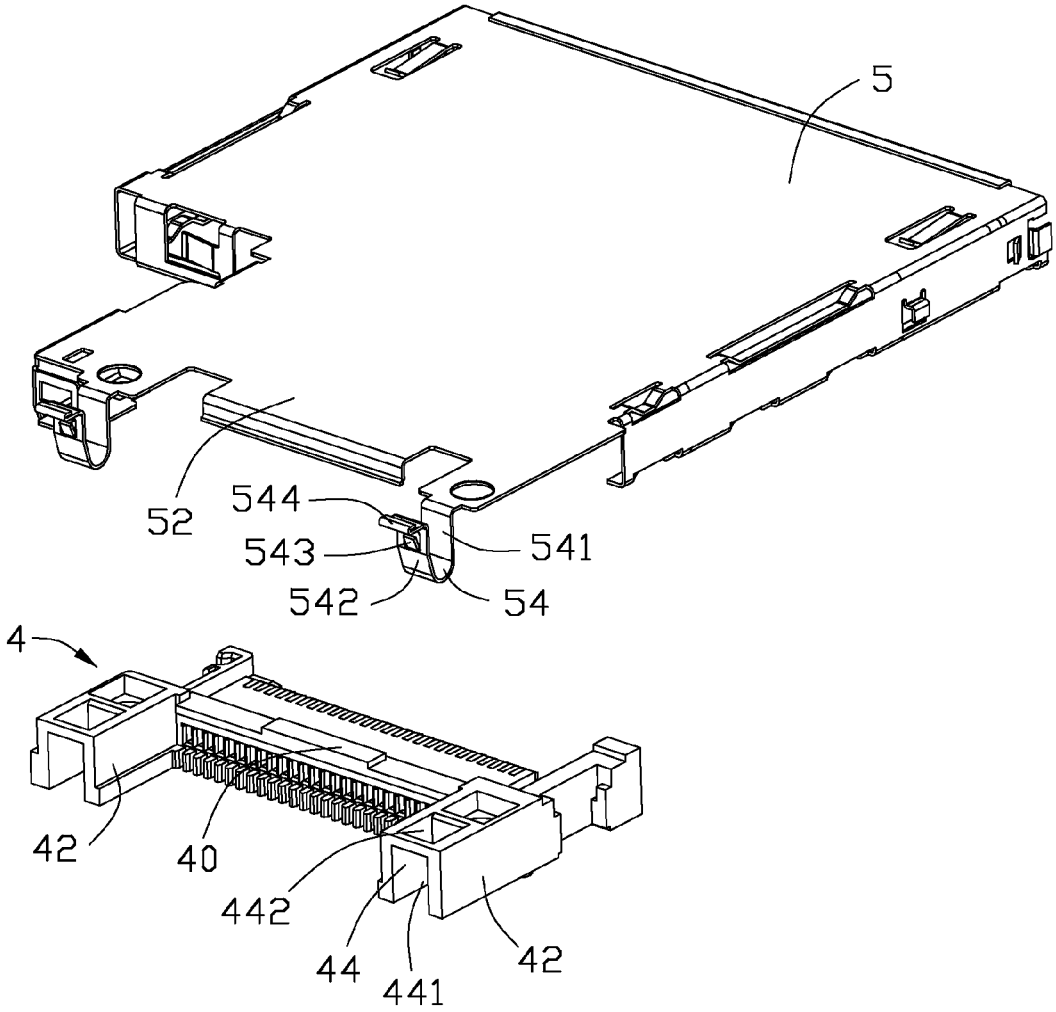
FIG. 5 is a perspective, exploded view of the electrical card connector of FIG. 4.

Referring to FIGS. 4-5, a second embodiment of the electrical card connector (not labeled) of the present invention is described as following. The electrical card connector includes an insulative housing 4, a plurality of contacts (not labeled) retained in the insulative housing 4, a metal shield 5 covering the insulative housing 4 for defining a card receiving room therebetween, all of above is same to the first embodiment of the electrical card connector. The second embodiment differentiates from the first embodiment of the electrical card connector at two locking portions 54 as labeled. The locking portion 54 is approximately U-shaped taken along a side view. The locking portion 54 includes a first elastic piece 541 extending downwardly from a front edge of the metal shield 5, a second elastic piece 542 turning reversely, forwardly and upwardly from the first elastic piece 541 and an operating portion 544 at a free end of the second elastic piece 542. The second elastic piece 542 forms a stamped portion 543 with a free end upwardly and outwardly away therefrom.

Referring again to FIG. 5, the insulative housing 4 is similar to the insulative housing 2 of the first embodiment. The insulative housing 4 forms a base portion 40 and a pair of retaining portions 42 extending forwardly from two ends of the base portion 40 along the card insertion direction. The retaining portion 42 also defines a cavity 44 having a first opening 442 on the upper surface thereof and a second opening 441 on a front surface thereof. The locking portion 54 protrudes into the cavity 44 from the first opening 442, during which the stamped portion 543 is compressed to have elasticity, and at last, the stamped portion 341 protrudes into the second opening 441 and engages with the retaining portion 42. The locking portion 54 is concaved in the L-shaped cavity 44, just providing a pre-loading engagement between the metal shield 5 and the insulative housing 4. In a repairing process, because the operating portion 544 is located on the upper surface of the retaining portion 42, i.e., exposed out of the cavity 44, the repairer easily pushes the operating portion 544 along a card ejection direction to disengage the stamped portion 543 with the retaining portion 42. Thereafter, the repairer easily separates the metal shield 5 away from the insulative housing 4 and checks what is wrong with the electrical card connector.

Figure 6:
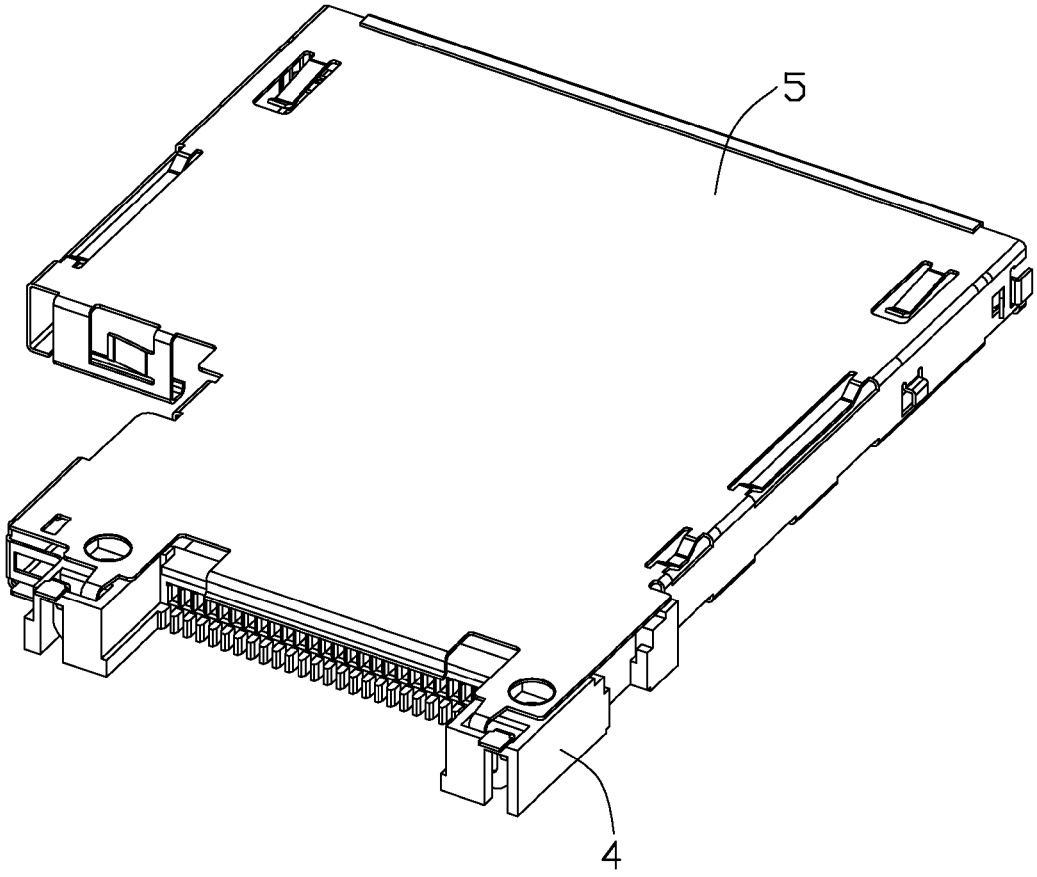
FIG. 6 is a perspective, assembled view of a third embodiment of the electrical card connector.
Figure 7:
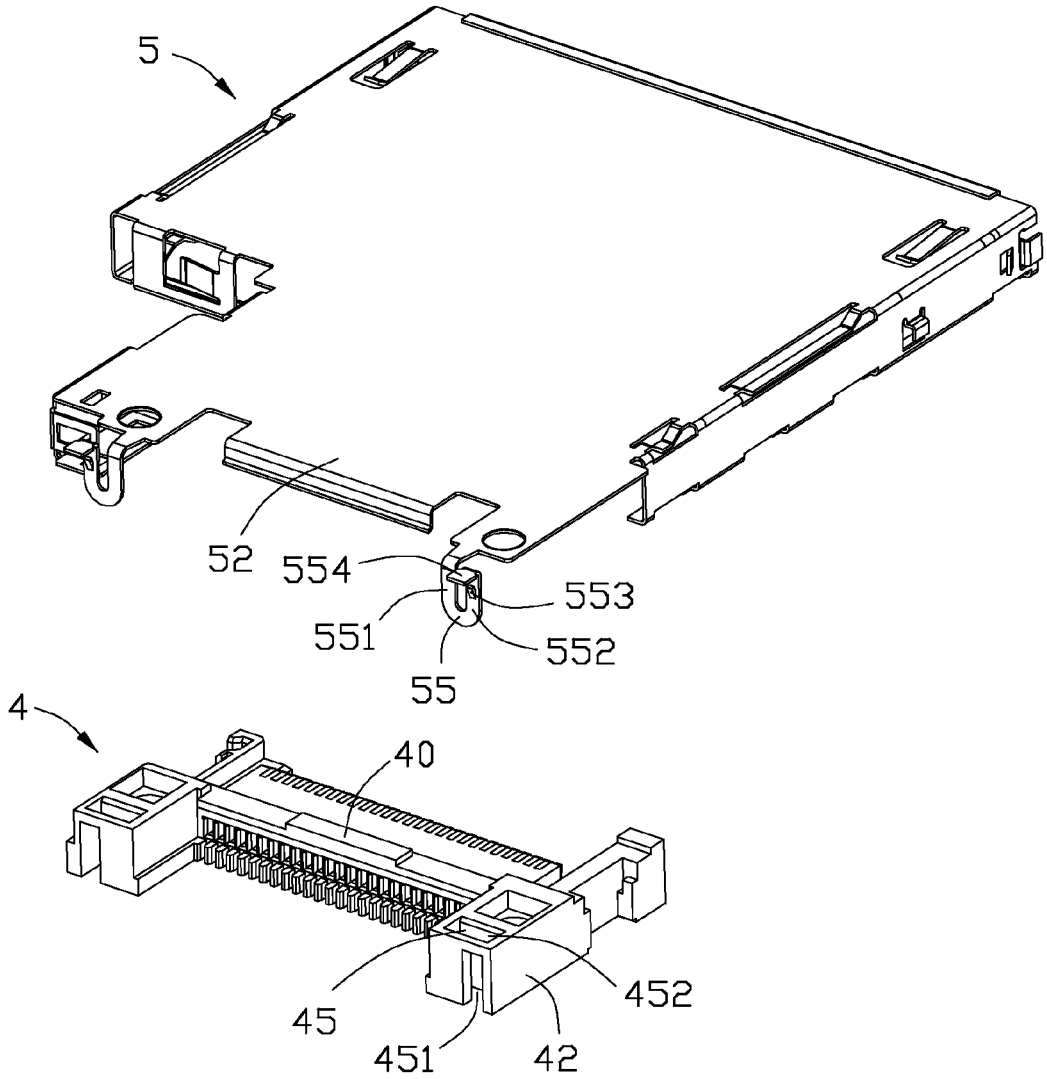
FIG. 7 is a perspective, exploded view of the electrical card connector of FIG. 6.

Referring to FIGS. 6-7, a third embodiment of the electrical card connector (not labeled) of the present invention is similar to the second embodiment forementioned. Differently, the metal shield 5 forms a locking portion 55 similar to the locking portion 54, having a first elastic piece 551 extending downwardly from a front edge of the metal shield 5, a second elastic piece 552 turning reversely, rightward and upwardly from the first elastic piece 551 and an operating portion 554 at a free end of the second elastic piece 552. The locking portion 55 is approximately U-shaped taken along a elevational, front view. The second elastic piece 552 forms a stamped portion 553 with a free end upwardly and outwardly away therefrom. The retaining portion 42 of the insulative housing 4 defines a cavity 45 having a first opening 452 on the upper surface thereof and a second opening 451 on a front surface thereof. The assembling process of the locking portion 55 and the retaining portion 42, and the disassembling process therebetween, are same to what have been disclosed in the second embodiment above, it is not described in detail here.

In the first, second and third embodiments mentioned above, in fact, the second openings 241, 441, 451 formed on front surfaces of the retaining portions 22, 42 are not limiting, other lateral surfaces, such as a left surface or a right surface are both all right. Accordingly, the locking portions 34, 54, 55 also need to turn around.

Figure 8:
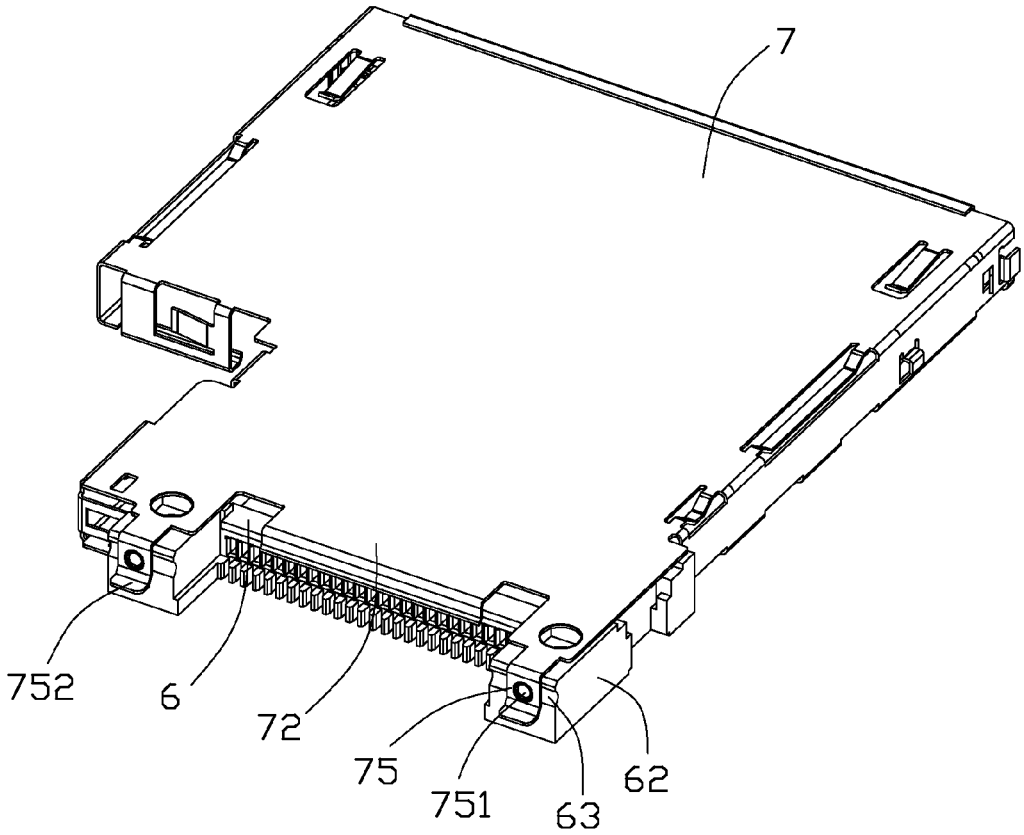
FIG. 8 is a perspective, assembled view of a fourth embodiment of the electrical card connector.
Figure 9:
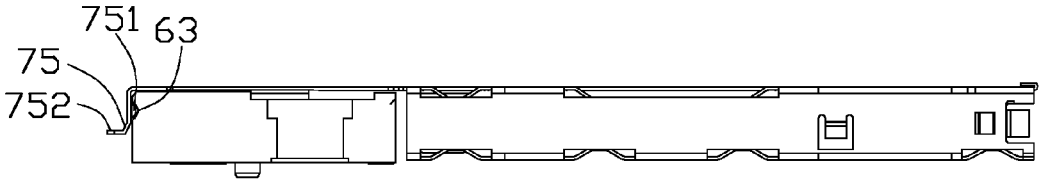
FIG. 9 is a side view of the electrical card connector of FIG. 8.

Referring to FIGS. 8-9, a fourth embodiment of the electrical card connector (not labeled) of the present invention will be described as following. The electrical card connector includes an insulative housing 6, a plurality of contacts (not labeled) retained in the insulative housing 6, a metal shield 7 covering the insulative housing 6 for defining a card receiving room therebetween. The metal shield 7 includes a pair of locking portions 75 extending downwardly from a front edge thereof. The insulative housing 6 has a pair of retaining portions 62 corresponding to the locking portions 75. The locking portion 75 defines a stamped portion 751 inwardly with two ends connecting with the locking portion 75. The retaining portion 62 defines a slit 63 for receiving the stamped portion 751. The slit 63 is regarded as a linear cavity functioning as the cavities 24, 44, 45. The locking portion 75 and the slit 63 just provide a pro-loading engagement between the metal shield 7 away from the insulative housing 6. In a repairing process, the repairer easily disengages the stamped portion 751 from the slit 63. Thereafter, the repairer directly easily breaks off the metal shield 7 from the insulative housing 6 with fingers without damage to the electrical card connector. In the fourth embodiment, the locking portion 75 prefers to have an operating portion 752 at a distal end thereof. Therefore, the repairer presses the operating portion 752 upward to make the stamped portion 751 slip away from the slit 63 and easily separates the metal shield 7 away from the insulative housing 6 thereby.

Figure 10:
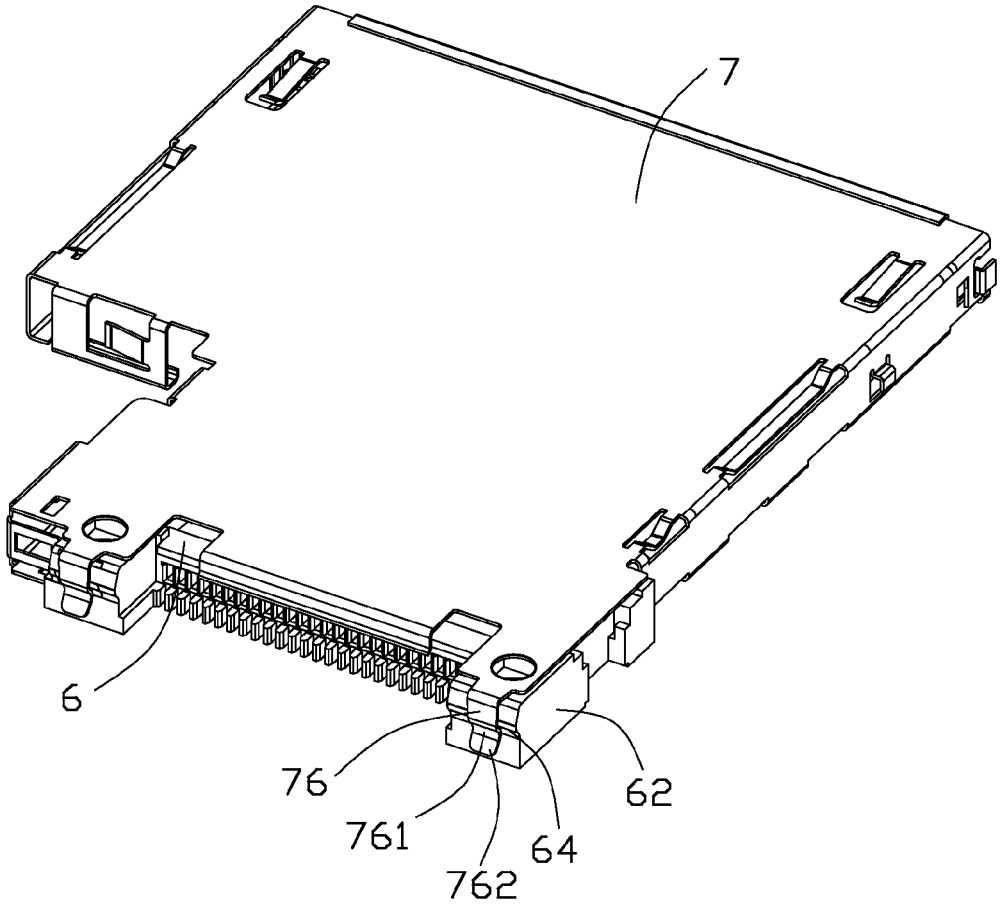
FIG. 10 is a perspective, assembled view of a fifth embodiment of the electrical card connector.
Figure 11:
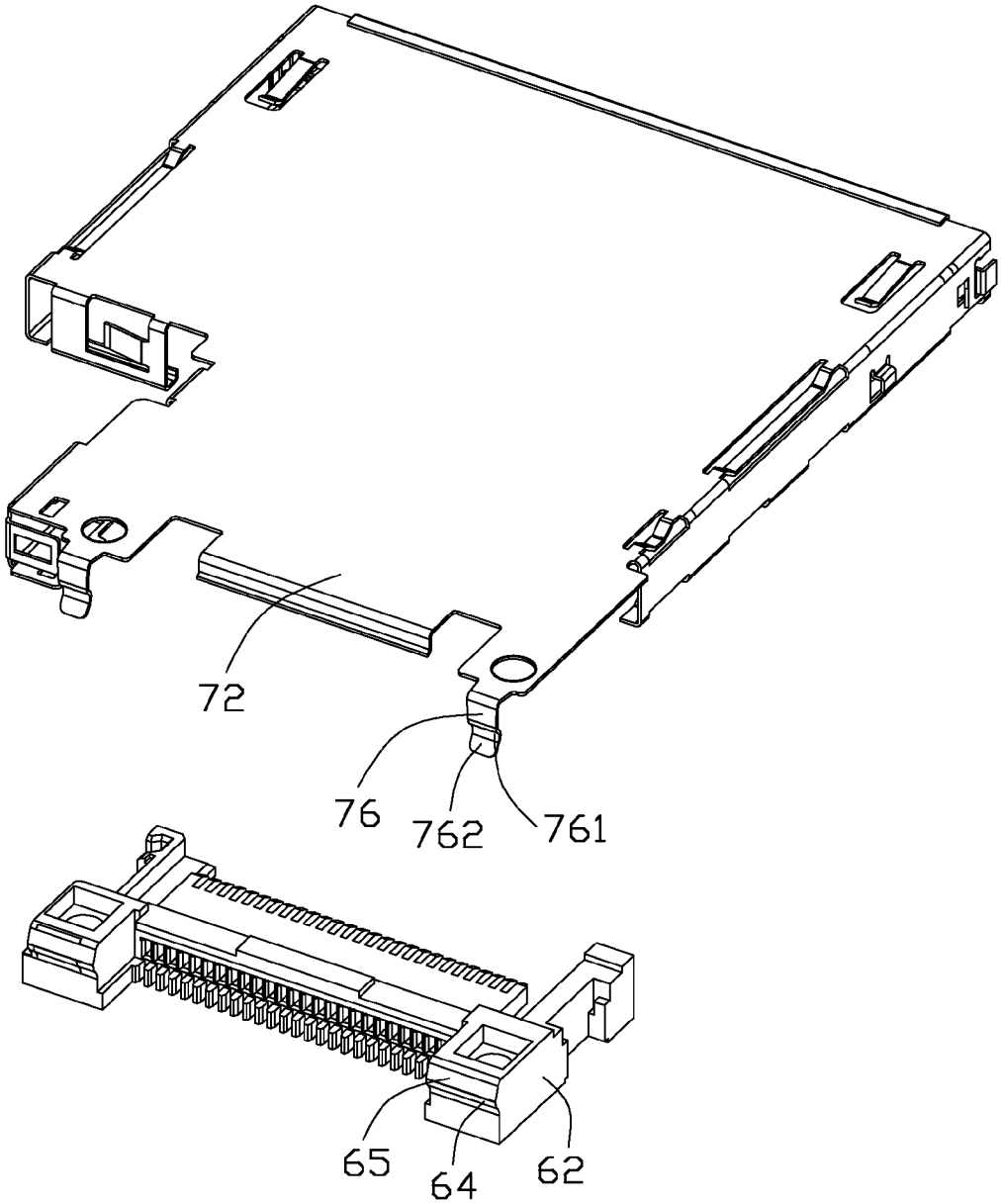
FIG. 11 is a perspective, exploded view of the electrical card connector of FIG. 10.

Referring to FIGS. 10-11, a fifth embodiment of the electrical card connector (not labeled) of the present invention is described as following. The metal shield 7 forms a pair of locking portions 76 at a front edge thereof. Differently, the locking portion 76 has a clipping portion 761. The retaining portion 62 forms a block portion 65, and a stepped portion 64 located below the block portion 65 and sinking from the blocking portion 65. The locking portion 76 enwraps the block portion 65 and the clipping portion 761 interferes with the stepped portion 64 for providing a pre-loading engagement. In a repairing process, the repairer directly easily breaks off the metal shield 7 from the insulative housing 6 with fingers without damage to the electrical card connector. The locking portion 76 prefers to have an operating portion 762 extending from the clipping portion 761 and therefore facilitates an operation of the repairer.

Figure 12:
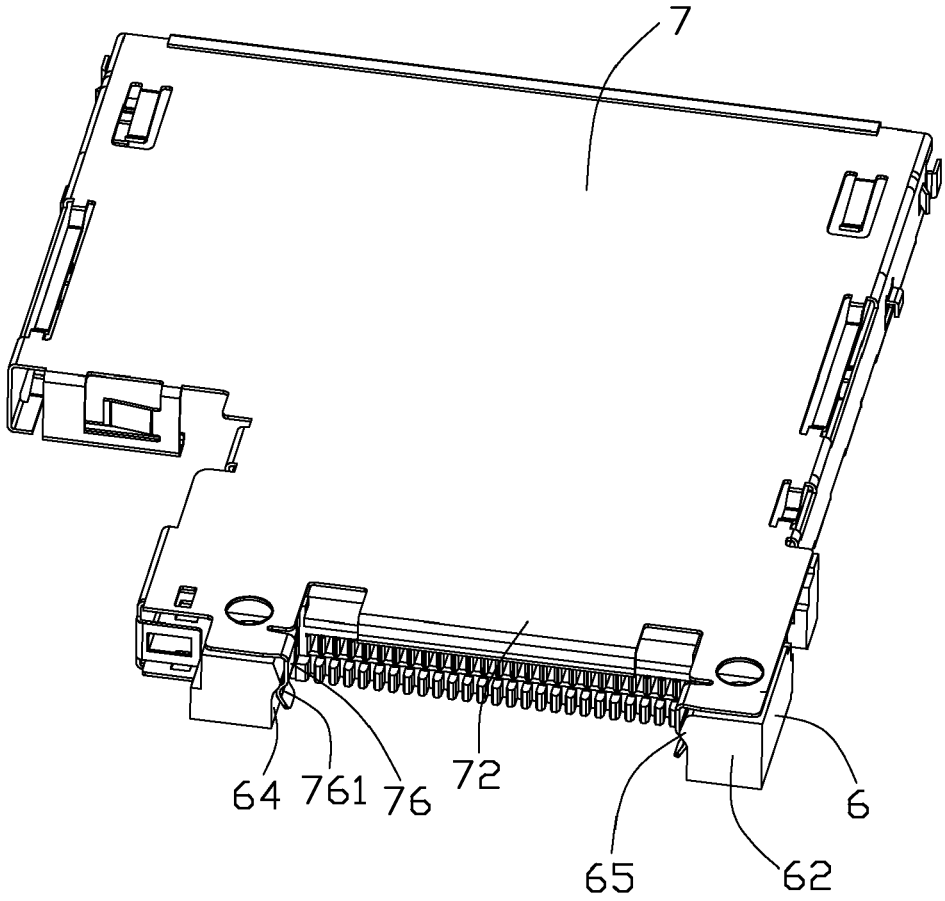
FIG. 12 is a perspective, assembled view of a sixth embodiment of the electrical card connector.

Referring to FIG. 12, a sixth embodiment of the electrical card connector (not labeled) of the present invention is similar to the fifth embodiment mentioned above. The locking portions 76 are formed at opposite inner sides instead of the front edge of the metal shield 7. The block portions 65 and the stepped portions 64 are correspondingly formed at opposite inner sides of the insulative housing 6. The assembling process of the locking portion 76 and the retaining portion 62, and the disassembling process therebetween, are same to what is disclosed in the fifth embodiment above, it is not described in detail here.

In the present invention, the electrical card connector provides locking portions 34, 54, 55, 75, 76 integral with the metal shield 3, 5, 7, and mated cavities 24, 44, 45 defined on the insulative housing 2, 4, or a slit 63 defined on the insulative housing 6, or mated stepped portions 64 formed on the insulative housing 6. The locking portions 34, 54, 55, 75, 76 are pre-loading engaged with the cavities 24, 44, 45, or the slit 63, or the stepped portions 64 such that the metal shield 3, 5, 7 is easily disassembled from the insulative housing 2, 4 without damage in a repairing process. Furthermore, the electrical card connector 100 includes a screwing bolt providing a main screwing force between the electrical card connector 100 and the PCB.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical card connector, comprising:

an insulative housing defining a plurality of passageways, the insulative housing having a base portion and a pair of retaining portions extending forwardly from the base portion, each retaining portion defining a cavity, the cavity having a first opening on an upper surface of the retaining portion and a second opening on a lateral surface of the retaining portion;

a plurality of contacts retained in the passageways; and a metal shield covering the insulative housing, comprising a main portion and a plurality of lateral walls for defining a card receiving room, the metal shield integrally forming a locking portion having a stamped portion therefrom; wherein the locking portion protrudes into the cavity from the first opening and the stamped portion is finally received in the second opening; and wherein the locking portion has two elastic pieces, with a first elastic piece connecting to the main portion of the metal shield and a second elastic piece approximately forming a U-shape with the first elastic piece, and the locking portion has an operating portion extending from the second elastic piece and being exposed out of the retaining portion.

2. The electrical card connector as described in claim 1, wherein the stamped portion is formed on the second elastic piece.

3. An electrical card connector, comprising:

an insulative housing defining a plurality of passageways, the insulative housing having a base portion and a pair of retaining portions extending forwardly from the base portion, each retaining portion defining a cavity, the cavity having a first opening on an upper surface of the retaining portion and a second opening on a lateral surface of the retaining portion;

a plurality of contacts retained in the passageways; and a metal shield covering the insulative housing, comprising a main portion and a plurality of lateral walls for defining a card receiving room, the metal shield integrally forming a locking portion having a stamped portion therefrom; wherein the locking portion protrudes into the cavity from the first opening and the stamped portion is finally received in the second opening; and wherein the locking portion has two elastic pieces, with a first elastic piece connecting to the main portion of the metal shield and a second elastic piece approximately forming a U-shape with the first elastic piece, wherein the retaining portion defines a pair of slots extending from an upper surface to a lower surface thereof, and the electrical card connector includes a pair of screwing bolts going through the slots to screw onto a printed circuit board.

* * * * *